US005374935A

United States Patent [19]

Forrest

[11] Patent Number: 5,374,935

[45] Date of Patent: Dec. 20, 1994

[54] COHERENT OPTICALLY CONTROLLED PHASED ARRAY ANTENNA SYSTEM

[75] Inventor: Stephen R. Forrest, Princeton, N.J.

[73] Assignee: University of Southern California, Los Angeles, Calif.

[21] Appl. No.: 21,485

[22] Filed: Feb. 23, 1993

[51] Int. Cl.[5] ..... H01Q 3/22

[52] U.S. Cl. ..... 342/368; 342/375

[58] Field of Search ..... 342/368, 375

[56] References Cited

U.S. PATENT DOCUMENTS

| | | | |
|---|---|---|---|
| 4,258,363 | 3/1981 | Bodmer et al. | 342/368 |
| 4,864,310 | 9/1989 | Bernard et al. | 342/368 |
| 4,885,589 | 12/1989 | Edward et al. | 342/368 |

OTHER PUBLICATIONS

Wallington et al, "Optical Techniques for Signal Distribution in Phased Arrays", 645 GEC Journal of Research (2) 1984 London.

W. Ng et al, "The First Demonstration of an Optically Steered Microwave Phased Array Antenna Using True-Time-Delay", in *IEEE Journal of Lightwave Technology*, vol. 9, No. 9, pp. 1124–1131 (Sep. 1991).

C. Hemmi et al, "Optically Controlled Phased Array Beamforming Using Time Delay", in *Proceedings Of DOD Fiber Optics Conference 1992*, pp. 60–63, McLean, Va. (1992).

S. Illek et al, "Over 7nm (875 GHz) Continuous Wavelength Turning by Tunable Twin-Guide (TTG) Laser Diode", in *Electronics Letters*, vol. 26, pp. 46–47 (1990).

M. Öberg et al, "Wide Continuous Wavelength Tuning of a Narrow Linewidth DBR Laser", in *IEEE Photonics Technology Letters*, vol. 4, No. 3, pp. 230–232 (Mar. 1992).

A. W. Davis et al, "Phase Diversity Techniques for Coherent Optical Receivers", in *IEEE Journal of Lightwave Technology*, vol. LT-5, No. 4, pp. 561–572 (Apr. 1987).

D. J. Hunkin et al, "Frequency-Locking of External Cavity Semiconductor Lasers Using an Optical Comb Generator", in *Electronics Letters*, vol. 22, No. 7, pp. 388–390 (27 Mar. 1986).

D. Dolfi et al, "Optically Controlled True Time Delays for Phased Array Antenna", in *SPIE vol. 1102 Optical Technology for Microwave Applications IV*, pp. 152–161 (1989).

H. Haus, "Proposed Scheme for Optically Controlled Phased Array Radar", in *Proceedings of DOD Fiber Optics Conference 1992*, pp. 60–63, McLean, Va. (1992).

*Primary Examiner*—Gregory C. Issing

*Attorney, Agent, or Firm*—Benman Collins & Sawyer

[57] ABSTRACT

A system architecture based on optical heterodyne transmission of signals from input (12) to antenna array (26), and vice versa, is provided. The system is based on conventional concepts of coherent, multichannel switching systems. The coherent optically controlled phased array antenna system of the invention comprises a transmitter system (10) and a receiver system (46). Due to their similar device requirements, it is possible that the same system can be switched from transmit to receive without introducing undo complexity into the architecture.

20 Claims, 4 Drawing Sheets

COHERENT OPTICALLY CONTROLLED PHASED ARRAY ANTENNA SYSTEM

ORIGIN OF INVENTION

This invention was made with Government support under Contract No. MDA-972-90-C-0037, awarded by DARPA. The Government has certain rights in this invention.

TECHNICAL FIELD

The present invention relates to antenna systems, and, more particularly, to phased array radar systems, employing optical control.

BACKGROUND ART

The realization of practical, optically controlled phased antenna arrays, which have received intensive interest due to their applications to microwave communication and radar systems, is currently hampered by the extreme complexity required in efficiently transmitting several hundred signals (or microwave delays) from the input (control) to the antenna array of the system. These difficulties are compounded by the demands of modern phased array systems including extremely high bandwidth broadcast frequencies (ranging from 20 to 60 GHz at up to 5 GHz bandwidth per channel), severe requirements on signal-to-noise and dynamic range, clutter cancellation, and the myriad requirements for beam forming including null steering, and generating multiple, squint-free beams at different frequencies. In addition, while problems regarding the transmission of the radar beam are relatively straightforward in their solution, there is still considerable controversy on the best means for receiving the return beam.

To date, several approaches have been suggested for solving optically controlled phased array antenna problems, although there have been only one or two practical demonstrations. Most architectures employ space division multiplexing to distribute a series of time or, less conveniently, phase delays to the antenna network; see, e.g., W. Ng et al, "The First Demonstration of an Optically Steered Microwave Phased Array Antenna Using True-Time-Delay", *IEEE Journal of Lightwave Technology*, Vol. 9, pp. 1124–1131 (1991) and C. Hemmi et al, "Optically Controlled Phased Array Beamforming Using Time Delay", *Proceedings of DoD Fiber Optics Conference* 1992, pp. 60–63, McLean, Va. (1992).

In these systems, the microwave delays are impressed on the optical carrier by using fibers or waveguide delay lines. This "true time delay" architecture then distributes the various delays to an antenna array via an optical switching matrix, such as a large integrated optic crossbar consisting of $LiNbO_3$ switches or laser or detector arrays, or alternatively, liquid crystal spatial light modulator "stacks", followed by electronic amplifiers needed to compensate for the insertion losses (sometimes approaching 100 dB in large scale implementations) of the switch.

One additional difficulty with this space division multiplexing architecture is that all fibers which transport the microwave/optical signals from the input to antenna terminals must be of the same length so as not to introduce extraneous phase shifts, time delays, or noise into the signals. Hence, these architectures have been proven to be limited by losses, they are difficult to implement, they are bulky, and are extremely costly.

An alternative approach is based on wavelength division multiplexing; see, for example, H. Haus, "Proposed Scheme for Optically Controlled Phased Array Radar", 3rd Annual DARPA Symposium on Photonics Systems for Antenna Applications, Monterey, Calif., Jan. 20, 1993. This system employs pulses from a chirped, mode-locked laser. The beat frequency of two adjacent Fourier frequency components from the laser (e.g., the nth and (n+1)th components), is upshifted in phase by an amount $\Phi \approx 2n+1$ from the beat frequency of the next two higher Fourier components. Thus, provided that one could fabricate tunable filters of sufficiently narrow spectral bandwidth to select a given Fourier component of the pulse spectrum, one could then extract all the phases at various antenna sites using pairs of tunable filters. These filters have been termed "channel dropping filters" (CDFs), and it was proposed by Haus, supra, that they be fabricated using semiconductor grating structures similar to those used in $\lambda/4$-shifted distributed feedback (DFB) lasers.

The difficulty with this approach is that it relies on very narrow bandwidth, tunable CDFs, which have yet to be demonstrated. One further problem is that this is a phase-delay architecture. True time delay is implementable, but only in a "coarse", wavelength multiplexed manner. These difficulties are counterbalanced, however, by the fact that all phase delays can be transmitted from input to antenna along a single fiber, and it is simple to utilize this concept in both transmit and receive modes.

Nevertheless, there remains a need for a phased array radar architecture which can accommodate hundreds of channels in a single fiber and process these hundreds of channels, which can substantially use existing components, and which can be configured in both a transmit and receive mode.

DISCLOSURE OF INVENTION

In accordance with the invention, a novel system architecture based on heterodyne transmission of signals from input to antenna array, and vice versa, is provided. The system is based on conventional concepts of coherent, multichannel switching systems.

The coherent optically controlled phased array antenna system of the invention comprises a transmitter system and a receiver system. The transmitter system comprises:

(a) a tunable input laser array, each laser in the input laser array provided with an output optical fiber, (b) a $n \times 1$ combiner with n tunable delays hard wired into the combiner using fiber loops, the $n \times 1$ combiner combining each output optical fiber from the tunable input laser array to form a single transmission fiber, (c) the transmission fiber provided with amplification means to compensate for $n^2$ splitting losses, (d) a $1 \times n$ splitter which splits amplified input from the transmission fiber into n signals, (e) n coherent optical receivers, each coherent optical receiver receiving an input from the $1 \times n$ splitter, (f) a tunable local oscillator laser array comprising n lasers, each laser associated with one of the coherent optical receivers, and (g) an antenna array comprising n antenna elements, each antenna element associated with one of the coherent optical receivers.

The receiver system comprises:

(a) an antenna array comprising n antenna elements, each antenna element adopted to receive a signal from an external source, (b) means for amplifying each signal from the antenna array, (c) a tunable input laser array adapted to receive the amplified signal from the amplifying means and to provide a modulated output signal, (d) a $1\times n$ combiner for combining the modulated signals, the $n\times 1$ combiner combining each modulated signal from the tunable input laser array to form a single transmission fiber, (e) the transmission fiber provided with fiber amplification means to compensate for $n^2$ splitting losses, (f) a $1\times n$ splitter which splits amplified input from the transmission fiber into n signals, the $1\times n$ splitter provided with n tunable delays hard wired into the splitter using fiber loops, (g) n coherent optical receivers, each coherent optical receiver receiving an input from the $1\times n$ splitter, (h) a tunable local oscillator laser array comprising n lasers, each laser associated with one of the coherent optical receivers, and (i) means for processing the signals from the coherent optical receivers.

The basic features of the system of the invention include:

(1) It can accommodate between 100 and 4,000 channels in a single fiber.

(2) It can be dynamically configured to provide either a unidirectional, i.e., focussed, signal or a "broadside" signal, i.e., full illumination in the forward direction.

(3) It uses only components and techniques that have already been developed. However, practical implementations will need to incorporate a high degree of integration of both lasers and receivers to accommodate a large number of antenna elements.

(4) It can be used in both transmit and receive mode. Indeed, with appropriate switching hardware, the same components used for the transmitter can be "turned around" to work in the receive mode as well.

(5) Potentially, the system can deliver very high power signals to the antenna due to the inherent gain in the architecture. No losses imply a good signal-to-noise ratio, calculated to be ~40 dB for 128 channels with an optical link loss of only ~3 dB for a 1 GHz instantaneous bandwidth at a wavelength of $\lambda=1.55$ μm. These 128 channels occupy only 3.0 to 3.5 nm spectral bandwidth.

BEST MODES FOR CARRYING OUT THE INVENTION

A novel architecture based on the optical heterodyne or homodyne transmission of signals from input to antenna array, and vice versa is described herein. The system expands upon conventional concepts of coherent, multichannel broadband transmission systems which have been under investigation for many years for applications in telecommunications. This antenna system can also be easily modified to work as a very broad band local area network, and has applications to numerous other "generic" communications and switching systems. In this sense, the system is highly leveraged against existing technologies and system needs, and at the same time introduces very significant advantages over existing phased array architectures. Hence, the system has the potential to provide extremely high performance to a wide range of applications at a comparatively low cost.

The coherent architecture can be implemented in both the transmit and receive antenna modes. These two modes will be discussed independently. However, due to their similar device requirements, it is possible that the same system can be switched from transmit to receive without introducing undo complexity into the architecture.

Figure 1:
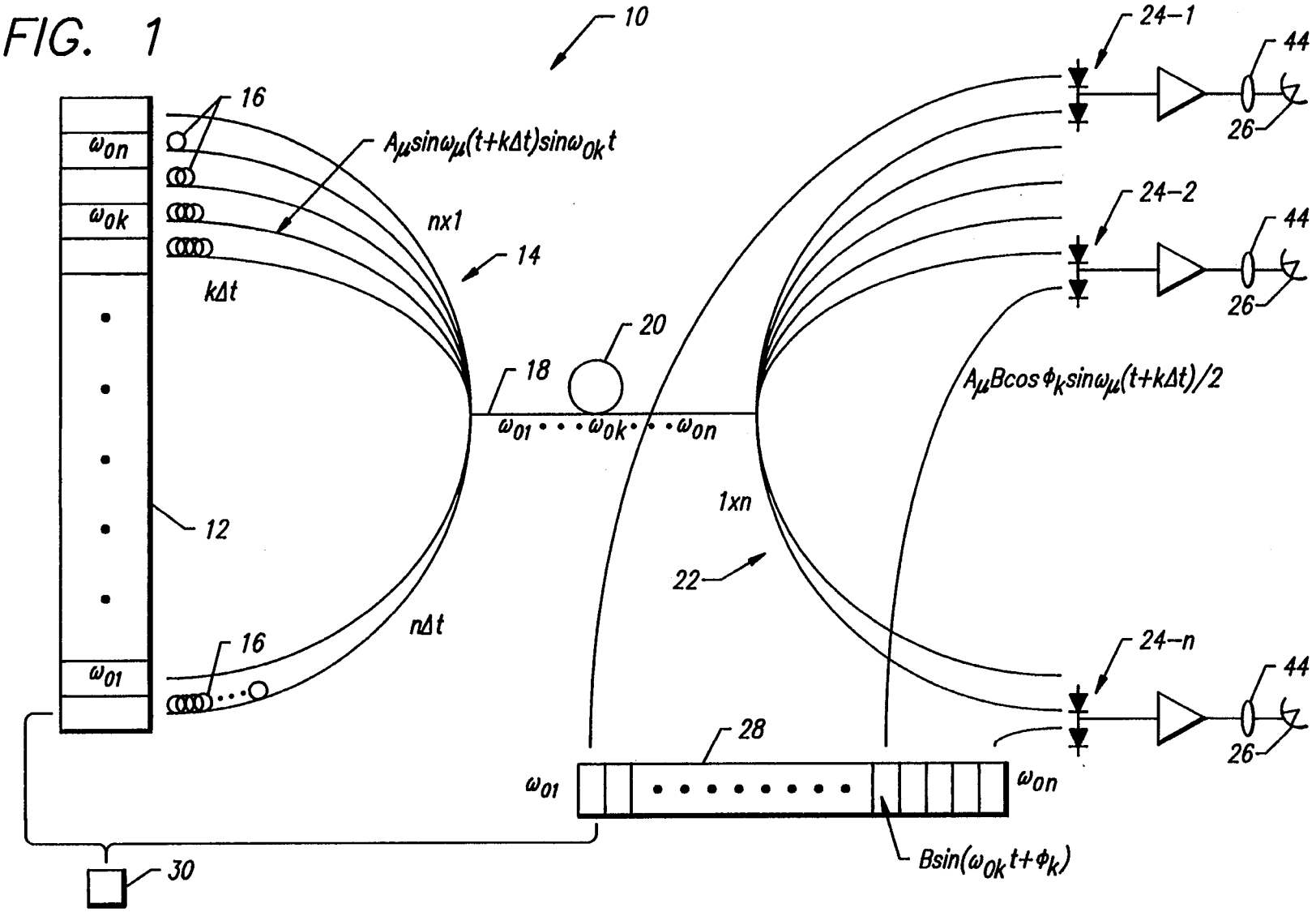
FIG. 1 is a schematic diagram of a coherent phased array transmitter in accordance with the invention.

FIG. 1 is a schematic diagram of the transmitter system 10. The major components are a tunable input laser array 12, a $n\times 1$ combiner 14 with n tunable delays 16 "hard wired" into the combiner using fiber loops or optical waveguide delay lines, a transmission fiber 18 with fiber amplification (shown by fiber amplifier 20) to compensate for the $n^2$ splitting losses of the two couplers (combiner 14 and $1\times n$ splitter 22), $1\times n$ splitter 22, n coherent optical receivers 24, and an antenna array 26. Also, there is a second, tunable local oscillator (LO) laser array 28 at the antenna end, and a reference laser 30 serving both the input array 12 and LO laser array 28. The reference laser 30 is one of several possible means for frequency locking the transmitter lasers 12.

In this system, all laser arrays 12, 28 consist of continuously frequency tunable lasers. Using present technology, up to nearly 100 Å tuning has been demonstrated at a center wavelength of $\lambda=1.55$ μm using three-section distributed feed-back (DFB) lasers; see, e.g., M. Oberg et al, "Wide Continuous Wavelength Tuning of a Narrow Linewidth DBR Laser", *IEEE Photonics Technology Letters*, Vol. 4, pp. 230–232 (1992) and S. Illek et al, "Over 7 nm (875 GHz) Continuous Wavelength Tuning by Tunable Twin-Guide (TTG) Laser Diode", *Electronics Letters*, Vol. 26, pp. 46–47 (1990). Given that 1 Å=12 GHz at $\lambda=1.55$ μm, and that each channel occupies a less than 1 to 2 GHz bandwidth, this implies that ~100 channels occupying 1.2 THz of available bandwidth can be accommodated using the heterodyne approach. Here, the interchannel spacing must exceed the bandwidth (BW) by 2 to 4 times to eliminate signal interference.

Figure 2:
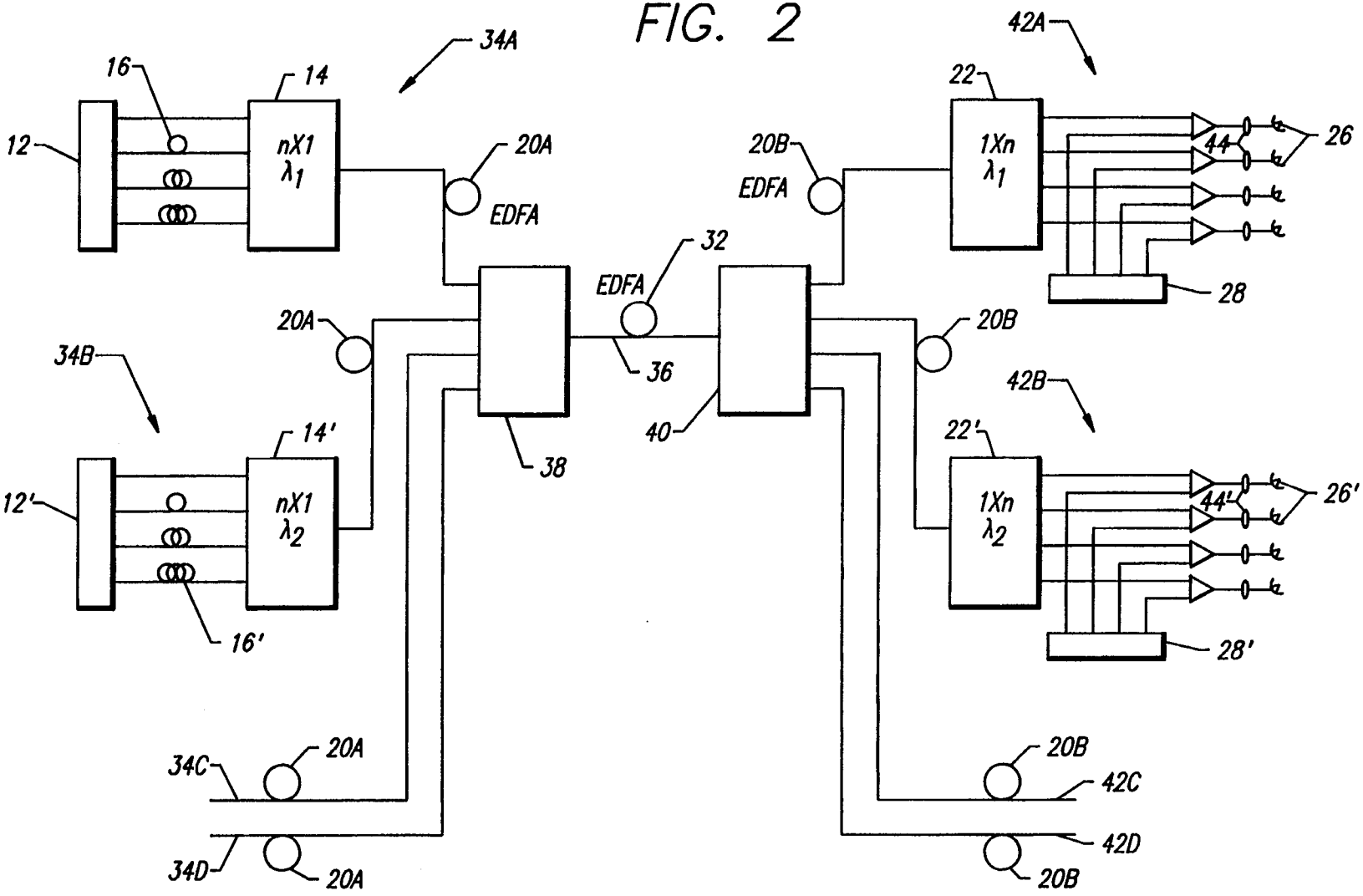
FIG. 2 is a wavelength multiplexed broadband phased array in accordance with the invention.

The useful spectral bandwidth of an optical fiber system of this type (i.e. where sources and detectors are separated by distances $\leqq 10$ km) may be $>0.1$ μm. Thus, to extend the number of channels one more order of magnitude, which can be useful for arrays with large ($>1{,}000$) numbers of elements, or in multifrequency, multibeam arrays, a wavelength multiplexed approach such as that depicted in FIG. 2 can be employed. In FIG. 2, "EDFA" indicates erbium-doped fiber amplifiers 20a, 20b, 32, which are used for compensating splitter, combiner and link losses. Alternatively, other optical amplifiers known in the art, such as those based on semiconductors, may be employed. Here, each 100 Å wide heterodyned sub-array 34a, 34b, 34c, 34d, etc., such as that shown in FIG. 1, is combined onto the single carrier fiber 36 using a wavelength multiplex grating 38. Following amplification in EDFA 32, the signal is demultiplexed by filter 40 and split into sub-arrays 42a, 42b, 42c, 42d, etc. in a more coarse-grained wavelength division multiplexed approach. Given an information channel bandwidth of 1 GHz, and a channel separation of 3×BW to eliminate undue interchannel interference in a heterodyne system where I.F.=BW, this 12 THz system thus has a channel capacity of 4,000 channels. Such a capacity should be sufficiently large to accommodate the largest communications and antenna array systems currently envisioned; see, e.g., C. Hemmi et al, supra.

In order to achieve a high S/N, combiners/splitters with EDFAs are implemented as follows: The n signals are first combined by m, (n/m+1)×1 passive couplers, followed by m EDFAs, with n being the number of delays and m being the number of couplers. Each combiner merges n/m signals along with a pump signal for an EDFA. After amplification, the signals are combined by an m×1 passive coupler and transmitted along the fiber transmission line. An EDFA is also used on the transmission line to further improve signal level. Similar to the combining section, the signals are split by a 1×(m+1) passive splitter, amplified by m EDFAs, and then further split by m 1×(n/m) passive splitters.

To estimate the viability of the phased array system of the architecture shown in FIG. 2, the system signal-to-noise ratio, $(S/N)_s$, and loss budget were calculated under the assumptions that the signals are transmitted at a channel frequency of 1.55 μm with a bandwidth of 1 GHz, and with 5 km between terminals. The value of $(S/N)_s$ can be estimated by: $(S/N)_s=(1/F)(S/N)_{trans}$, where the laser transmitter at 1 GHz is given by the relative intensity noise of the laser, i.e., $(S/N)_{trans}=\sim 70$ dB and F, the noise figure, is found using:

$$F=L_{c1}F_{a1}+\{L_{c1}/G_{a1}\}(L_{c2}F_{a2}-1\}+\ldots+\{L_{c1}L_{c2}\ldots L_{cm-1}/G_{a1}G_{a2}\ldots G_{am-1}\}\{L_{cm}F_{am}-1\}$$

Here, $L_{ci}$ is the loss of the i-th stage, $F_{ai}$ is the noise figure of the i-th amplifier, and $G_{ai}$ is the gain of the i-th channel. Table I gives performance data for the main components of the system for a 128 channel link with n=128 and m=8. The optical gain and output power for an EDFA can be as large as ~22 dB and 18.5 dB, respectively, and the noise figure is 4 dB. In Table I, the excess loss is based on 0.1 dB for each splice connection.

TABLE I

Data for EDFA Network.

| Component | Optical Loss, dB | Excess Loss, dB | Optical Gain, dB | Noise Figure, dB | Optical Signal Power Relative to Input Signal, dB |
|---|---|---|---|---|---|
| 16 × 1 Combiner Loss ($L_{c1}$) | 12 | 0.2 | | | −12.2 |
| EDFA ($G_{a1}$, $F_{a1}$) | | | 21.2 | 4 | 9 |
| 8 × 1 Combiner Loss ($L_{c2}$) | 9 | 0.2 | | | −0.2 |
| Fiber Loss ($L_{c2}$) | 1 | | | | −1.2 |
| EDFA ($G_{a2}$, $F_{a2}$) | | | 10.2 | 4 | 9 |
| 1 × 8 Splitter Loss ($L_{c3}$) | 9 | 0.2 | | | −0.2 |
| EDFA ($G_{a3}$, $F_{a3}$) | | | 9.2 | 4 | 9 |
| 1 × 16 Splitter Loss ($L_{c4}$) | 12 | 0.2 | | | −3.2 |

The overall noise figure of the EDFA implementation is ~30 dB and the $(S/N)_s$=70 dB−30 dB=~40 dB. From laser transmitter to the optical receiver, the system has ~3 dB of optical loss. Additionally, the gain of the EDFA is relatively flat between 1.530 μm and 1.560 μm. Therefore, the $(S/N)_s$ performance for all channels of a wavelength division multiplexed system is ~40 dB.

Returning to FIG. 1, the system operates as follows: A microwave signal, generated by an RF generator (not shown), of bandwidth $\omega_\mu/2\pi$ modulates the output of the kth wavelength-tunable laser 12 (using either direct or external modulation) to generate an optical signal $A_\mu \sin(\omega_\mu t)$. While direct laser modulation is the most convenient means for beam forming, it can lead to frequency chirp which would destroy the stability of the signal. On the other hand, external modulation is free from chirp, although coupling losses and wavelength sensitivity present practical limitations to its implementation. Given that the signal needs to be delayed by k time increments, Δt, then this particular laser is tuned to emit at a wavelength $\lambda_k=c/\omega_{ok}$, where c is the speed of light. Hence, the signal delayed by kΔt, provided by delay means 16 is given by (ignoring, for simplicity of argument, quadrature terms):

$$A_\mu \sin[\omega_\mu(t+k\Delta t)]\sin(\omega_{ok}t).$$

This signal is then combined with the n−1 other tunable delays with a resolution of l bits onto the transmission line 18. The signals are amplified by the EDFA 20 (or other optical amplification means, such as semiconductor optical amplifiers) to compensate for combiner, splitter and link losses, and are then distributed to the coherent balanced receivers 24 using the 1×n splitter 22. Essentially, what has been created is a "look-up" table associating n optical frequencies with n delays of l-bit resolution in a true-time-delay architecture. At the antenna end 26, each of the n optical signals are incident on n receivers 24, along with n local oscillator signals from array 28. Here, the local oscillators are tuned to provide receiver 24-1 (at the top of FIG. 1) with frequency $\omega_{o1}$, receiver 24-2 with $\omega_{o2}$, . . . , receiver 24-n with $\omega_{on}$. Given that the kth local oscillator 28 is at $B_k \sin(\omega_\mu t+\phi_k)$, then the signal at the output of the kth receiver 24 is proportional to:

$$A_\mu B_k G_k \cos(\phi_k) \sin[\omega_\mu(t+k\Delta t)]/2,$$

where $G_k$ is the product of all the gains (including amplifier and EDFA gain) and losses in the link. This signal is then delivered to the kth antenna 26 at the RF frequency (typically between 20 to 60 GHz) by "upshifting" the signal through a voltage controlled oscillator (VCO) 44. Thus, the coherent system has efficiently delivered the time delay to the appropriate antenna element 26. To sweep the beam (typically occurring on a time scale of milliseconds), the input laser frequencies from the input laser array 12 (or alternatively the LO frequencies from the LO laser array 28) must be changed to create a new correspondence between a given delay 16 and an output antenna 26.

Finally, it will be noted that the signal amplitude is sensitive to factors including the optical beam polarization and phase ($\phi_k$). This suggests that phase and polarization-diversity receivers can be advantageously employed as the coherent receivers 24 in this application; see, e.g., A. W. Davis et al, "Phase Diversity Techniques for Coherent Optical Receivers", *IEEE Journal of Lightwave Technology*, Vol. 5, pp. 561–572 (1987). It will also be noted that the signal is proportional to the local oscillator (LO) strength, $B_k$, from the LO laser array 28. Typically, this can be as high as 10 mW at $\lambda=1.55$ μm, thus delivering considerable gain and power to the system at the antenna end 26. Indeed, both amplifier 20 and LO 28 gain can be tuned at each antenna element 26 to "shape" the beam to provide a flexible radiation pattern. Furthermore, by tuning the LO array 28 to a single optical frequency, the beam can operate in the "broadside" mode to illuminate the forward direction.

Frequency reference can be provided to each tunable DFB laser in the arrays 12, 28 by one of several techniques, depending on whether the system uses homodyne (with an intermediate frequency of zero, i.e. $\omega_{IF}=0$) or heterodyne detection. For heterodyne detection, the receiver 24 can tune from the IF in a frequency-locked loop; see, e.g., A. W. Davis, et al, supra. The basic receiver design employs a 3 dB coupler to inject the mixed signals from the LO array 28 and the 1×n splitter 22 beams onto two, identical detectors **24*a*, 24*b* connected in an anode-to-cathode configuration to the input of high gain amplifier 44. To tune from the IF, the mixed signal from the LO array 28 and the 1×n splitter 22** is strongly RF filtered (by means not shown) to avoid cross-talk from adjacent channels. The tuned output of the IF filter is then used to lock the multi-section laser frequency to that of the optical signal.

One other means for providing simultaneous external reference to all n channels in either a heterodyne or homodyne system is to use as the reference laser 30 a mode-locked laser which generates a "comb" of equally spaced Fourier-component frequencies (see FIG. 1). Optical comb generators are discussed by D. J. Hunkin et al, "Frequency Locking of External Cavity Semiconductor Lasers Using an Optical Comb Generator", *Electronics Letters*, Vol. 22, pp. 388–390 (1986). This comb then injection-locks the individual lasers which have been roughly "current-tuned" to a particular frequency component. That is, injection-locking a current-tunable laser using a comb of frequency components changes the linear relationship between laser tuning current and wavelength into a "stepwise" laser output spectrum, with steps at the separate channel frequencies. For this scheme to work, each of the lasers in the array needs to be pre-tuned close to its particular optical carrier frequency using careful calibration, external (tunable) cavities, temperature and current control, etc.

As can be seen from FIG. 1, one fiber 18 is used to transmit all delays or phase shifts. The LO laser array 28 must be frequency "agile" to accommodate broadcast configuration, as discussed above. At a wavelength of 1.5 μm, 1 Å=12 GHz, which implies 3 to 4 channels/Å, or >300 channels/100 Å tunable laser BW. More channels can be accommodated by wavelength division multiplexing of parallel systems.

Figure 3:
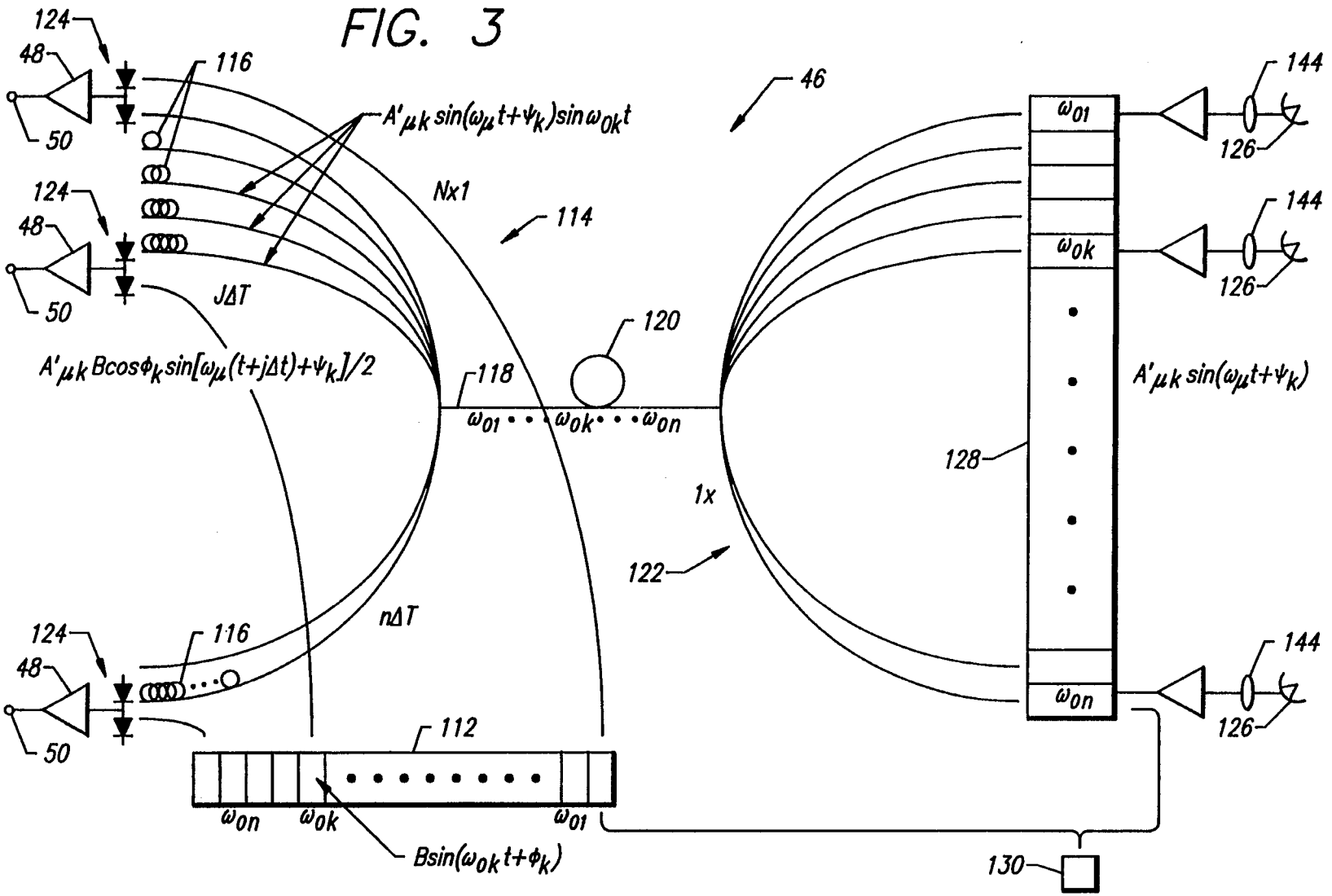
FIG. 3 is a schematic diagram of a coherent phased array receiver in accordance with the invention.

FIG. 3 is a schematic layout of the coherent optically controlled phased antenna array receiver 46. In comparing this Figure with FIG. 1, it is seen that many of the same components and techniques are used for both transmit and receive, and thus the same reference numerals, preceded by "1", are used to designate identical elements. Here, the receive signal (after RF down-conversion), is $$A'_{\mu k} \sin(\omega_\mu t+\Psi_k),$$

where $\omega_\mu$ once more denotes the microwave information bandwidth. This signal is amplified by amplifier 144 and then placed on an optical carrier at frequency $\omega_{ok}$ using the input laser array 128 (which can be the same as the LO array 28 used in the transmit system). Hence, all n return signals are associated with n optical carriers, and are transmitted to the near terminal end of the system in the form:

$$A'_{\mu k} \sin(\omega_\mu t+\Psi_k) \sin(\omega_{ok} t),$$

using the 1×n splitter 22 as a 1×n combiner 122.

Once again, the signal is amplified using an EDFA 120, and is split n ways using the input n×1 combiner 14 as an n×1 splitter 114. To "point" the antenna in the receive mode, this kth signal undergoes delay at all of the tunable delay loops 116 in the combiner in the same optical network as that used in the transmitter 10. Then this channel is given a jΔt delay by mixing the kth input signal with the local oscillator 112 at frequency $\omega_{ok}$ at the jth coherent receiver 124. It will be noted that the input laser array 12 on the transmitter 10 is now the LO array 112 on the receiver 46. This has the feature of amplifying the signal once again by the local oscillator power, $B'_k$, to give an output signal of $$A'_{\mu k} B'_k G'_{\mu k} \cos(\phi_k) \sin[\omega_\mu(t+j\Delta t)+\Psi_k]/2.$$

The product of all losses and gains in the system is given by $G'_{\mu k}$. Typically, it is expected that $B'_k G'_{\mu k} >> 1$. By adjusting the LO weights ($B'_k$) and gains, the input beam pattern can be shaped. This is useful for receiver beam pointing, null steering, and for achieving other beam conditioning operations which are useful in various applications.

An output amplifier 48 amplifies the signal from the coherent receiver 124, and provides an amplified output signal at output terminal 50 for further processing by other circuitry (not shown).

Other features of the receiver 46 are similar to the transmitter 10 discussed above. For example, receivers with a large number of channels can be wavelength multiplexed using means identical to those used for the transmitter (see FIG. 2). Further, as can be seen from FIG. 3, one fiber 118 is used for all delays or phase shifts.

Figure 4:
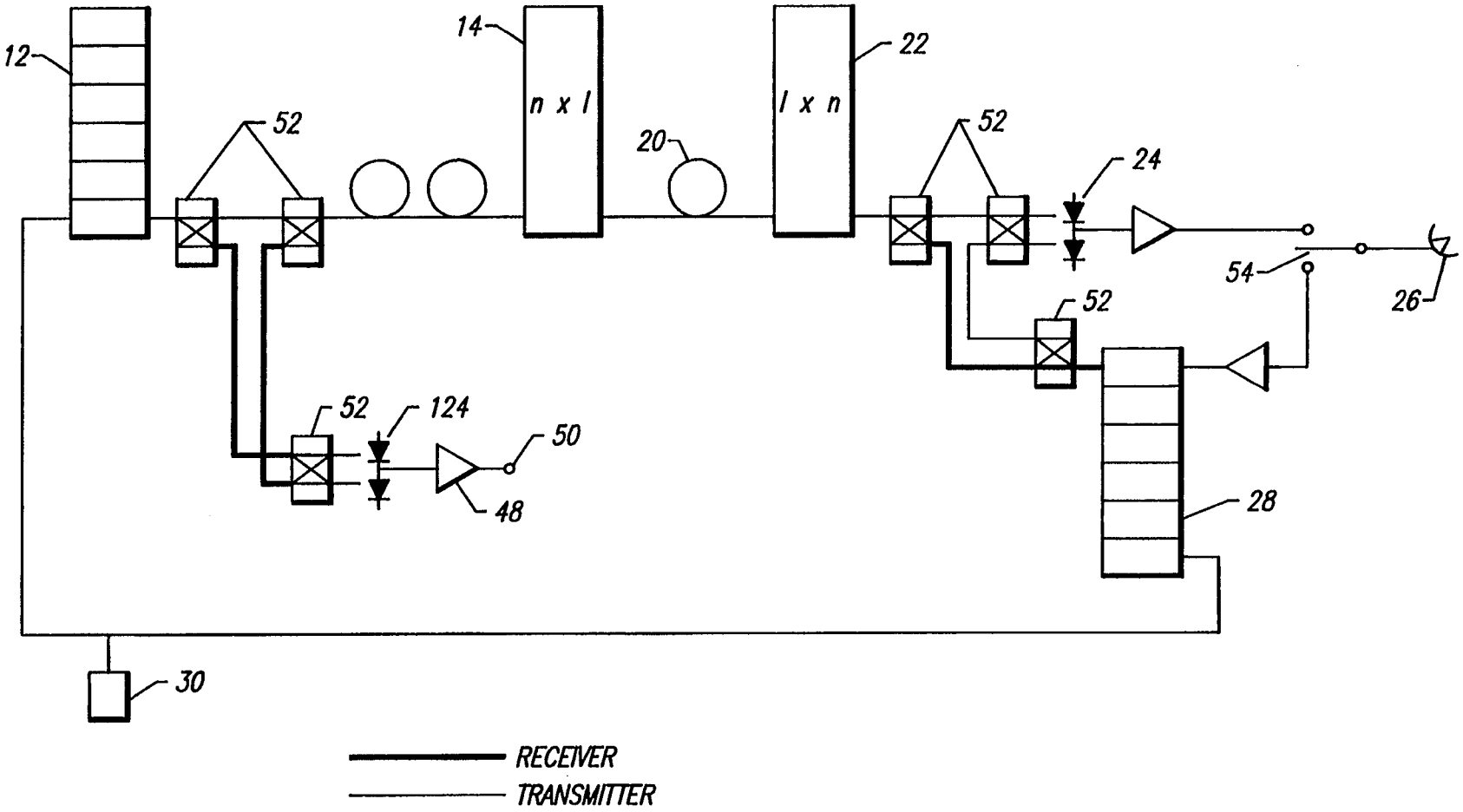
FIG. 4 is a schematic diagram of use of a switchable coherent phased array transmitter/receiver, where many of the same components of the transmitter of FIG. 1 may be used as the receiver of FIG. 3.

Many of the same components of the transmitter 10 may be used to work in the receive mode of the receiver 46, using appropriate switching hardware. FIG. 4 depicts a schematic diagram of such an example for a single channel. The same fiber "harness" may be employed, using optical coupler/switches 52 to switch the terminal gear in and out. An electrical switch 54 converts from the transmitter mode to the receiver mode and back.

In summary, the features of the coherent optically controlled phased array are:

(1) It can accommodate >300 high bandwidth channels in a single fiber. With the addition of a multi-wavelength system, over 4,000 channels can be accommodated in this single fiber architecture.

(2) It can be dynamically configured to provide either a unidirectional signal or a "broadside" signal. It can be used for implementing null steering, multiple beam formation, and squint-free multiple beam frequency operation. This flexibility is a feature of the high gain inherent to the system (due to a combination of optical amplification, electronic amplification and LO gain), and the rapid tunability of the gain elements which would allow for changing the beam shape during a single sweep. The slowest tunable element is the LD, where restabilization of frequency must occur on a time scale somewhat shorter than the beam scan time (~milliseconds).

(3) Due to the true-time-delay nature of the system, multiple frequency beams can be accommodated without compensating for squint.

(4) It uses many components and techniques which have already been developed by the communications industry. For example, it takes advantage of significant recent progress in tunable lasers, fiber amplifiers and coherent phase and polarization diversity receivers. However, practical realizations would need to incorporate a high degree of integration of both lasers and receivers.

(5) Potentially, the system can deliver very high power signals to the antenna due to inherent gain the architecture.

INDUSTRIAL APPLICABILITY

The coherent optically controlled phased array antenna system is expected to find use in a variety of radar and communication systems requiring processing of multi-channel signals, immunity for electromagnetic interference, and light weight.

Thus, there has been disclosed a coherent optically controlled phased array antenna system. It will be readily apparent to those skilled in this art that various changes and modifications of an obvious nature may be made, and all such changes and modifications are considered to fall within the scope of the invention, as defined by the appended claims.

What is claimed is:

1. A coherent optically controlled phased array antenna system comprising:

(a) a transmitter system, said transmitter system comprising (1) a plurality of tunable input laser arrays, each laser in each said input laser array provided with an output optical fiber, (2) a plurality of n×1 combiners with n tunable delays hard wired into each said combined using fiber loops, each said n×1 combiner associated with a said input laser array, each said n×1 combiner combining each output optical fiber from an associated said tunable input laser array to form a single transmission fiber associated with a said n×1 combiner, (3) each said transmission fiber provided with optical amplification means to compensate for $n^2$ splitting losses, (4) wavelength multiplex means for combining each transmission fiber onto a single carrier fiber, (5) wavelength demultiplex means for splitting said single carrier fiber into a plurality of fibers, (6) a plurality of 1×n splitters which split amplified input from said transmission fiber into n signals, each 1×n splitter associated with a fiber, (7) a plurality of coherent optical receiver arrays, each said n coherent receiver array associated with a said 1×n splitter and comprising n coherent receivers, each said coherent optical receiver array receiving an input from said 1×n splitter associated therewith, (8) a plurality of tunable local oscillator laser arrays, each array comprising n lasers, each laser associated with one of said coherent optical receivers, and (9) a plurality of antenna arrays, each array comprising n antenna elements, each antenna element associated with one of said coherent optical receivers; and (b) a receiver system, said receiver system comprising (1) a plurality of antenna arrays, each array comprising n antenna elements, each antenna element adapted to receive a signal from an external source, (2) means for amplifying each signal from each said antenna array, (3) a plurality of tunable input laser arrays adapted to receive the amplified signal from the amplifying means and to provide a modulated output signal, (4) a plurality of n×1 combiners for combining the modulated signals, each said n×1 combiner associated with a said tunable output laser array, each said n×1 combiner combining each modulated signal from an associated said tunable input laser array to form a single transmission fiber associated with a said n×1 combiner, (5) each said transmission fiber provided with optical amplification means to compensate for $n^2$ splitting losses, (6) wavelength multiplex means for combining each transmission fiber onto a single carrier fiber, (7) wavelength demultiplex means for splitting said single fiber into a plurality of fibers, (8) a plurality of 1×n splitters which split amplified input from said transmission fiber into n signals, each splitter associated with a fiber, each said 1×n splitter provided with n tunable delays hard wired into said splitter using fiber loops, (9) a plurality of coherent optical receiver arrays, each said coherent receiver array associated with a said 1×n splitter and comprising n coherent receivers, each said coherent optical receiver array receiving an input from said 1×n splitter associated therewith,

(10) a plurality of tunable local oscillator laser arrays, each array comprising n lasers, each laser in a said array associated with one of said coherent optical receivers in a said receiver array, and

(11) means for processing said signals from said coherent optical receiver arrays.

2. The coherent optically controlled phased array antenna system of claim 1 further including a plurality of reference lasers, each operatively associated with both a said input laser array and a said local oscillator laser array in both said transmitter and said receiver systems.

3. The coherent optically controlled phased array antenna system of claim 1 wherein switching means is provided to switch from said transmitter system to said receiver system.

4. The coherent optically controlled phased array antenna system of claim 3 wherein each said input laser array of said receiver system is the same as each said local oscillator laser array of said transmitter system.

5. The coherent optically controlled phased array antenna system of claim 3 wherein each said local oscillator laser array of said said receiver system is the same as each said input laser array of said transmitter system.

6. The coherent optically controlled phased array antenna system of claim 3 wherein each said $n \times 1$ combiner with n tunable delays of said transmitter system is the same as each said $1 \times n$ splitter with n tunable delays of said receiver system.

7. The coherent optically controlled phased array antenna system of claim 3 wherein each said $1 \times n$ splitter of said transmitter system is the same as each said $n \times 1$ combiner of said receiver system.

8. The coherent optically controlled phased array antenna system of claim 1 wherein each said transmission fiber provided with optical amplification means is the same in both said transmitter and receiver systems.

9. The coherent optically controlled phased array antenna system of claim 8 wherein said optical amplification means comprises a fiber optical amplifier.

10. The coherent optically controlled phased array antenna system of claim 8 wherein said optical amplification means comprises a semiconductor optical amplifier.

11. A plurality of coherent optically controlled phased array antenna sub-systems, each sub-system comprising a transmitter system and a receiver system, said plurality of sub-systems connected by a coupling system comprising:

(a) a wavelength multiplexer for combining the output signals of each transmitter sub-system onto a single transmission fiber;

(b) said transmission fiber provided with optical amplification means to compensate for $n^2$ splitting losses; and (c) a wavelength demultiplexer for splitting the amplified output signals into a plurality of demultiplexed signals into each receiver sub-system, each said transmitter system comprising:

(1) a tunable input laser array, each laser in said input laser array provided with an output optical fiber, (2) a $n \times 1$ combiner with n tunable delays hard wired into said combiner using fiber loops, said $n \times 1$ combiner combining each output optical fiber from said tunable input laser array to form a single transmission fiber, (3) said transmission fiber provided with fiber amplification means to compensate for $n^2$ splitting losses, (4) a $1 \times n$ splitter which splits amplified input from said transmission fiber into n signals, (5) n coherent optical receivers, each coherent optical receiver receiving an input from said $1 \times n$ splitter, (6) a tunable local oscillator laser array comprising n lasers, each laser associated with one of said coherent optical receivers, and (7) an antenna array comprising n antenna elements, each antenna element associated with one of said coherent optical receivers; and each said receiver system comprising:

(1) an antenna array comprising n antenna elements, each antenna element adopted to receive a signal from an external source, (2) means for amplifying each signal from said antenna array, (3) a tunable input laser array adapted to receive the amplified signal from the amplifying means and to provide a modulated output signal, (4) a $n \times 1$ combiner for combining the modulated signals, the $n \times 1$ combiner combining each modulated signal from said tunable input laser array to form a single transmission fiber, (5) said transmission fiber provided with fiber amplification means to compensate for $n^2$ splitting losses, (6) a $1 \times n$ splitter which splits amplified input from said transmission fiber into n signals, said $1 \times n$ splitter provided with n tunable delays hard wired into said splitter using fiber loops, (7) n coherent optical receivers, each coherent optical receiver receiving an input from said $1 \times n$ splitter, (8) a tunable local oscillator laser array comprising n lasers, each laser associated with one of said coherent optical receivers, and (9) means for processing said signals from said coherent optical receivers.

12. The plurality of coherent optically controlled phased array antenna sub-systems of claim 11 further including a reference laser operatively associated with each of said input laser arrays of a said transmitter system and each of said local oscillator laser arrays of a said receiver system.

13. The plurality of coherent optically controlled phased array antenna sub-systems of claim 11 wherein switching means is provided to switch from said transmitter system to said receiver system.

14. The plurality of coherent optically controlled phased array antenna sub-systems of claim 13 wherein each said input laser array of said receiver system is the same as each said local oscillator laser array of said transmitter system.

15. The plurality of coherent optically controlled phased array antenna sub-systems of claim 13 wherein each said local oscillator layer array of said said receiver system is the same as each said input laser array of said transmitter system.

16. The plurality of coherent optically controlled phased array antenna sub-systems of claim 13 wherein each said $n \times 1$ combiner with n tunable delays of each said transmitter system is the same as each said $1 \times n$ splitter with n tunable delays of each said receiver system.

17. The plurality of coherent optically controlled phased array antenna sub-systems of claim 13 wherein each said $1 \times n$ splitter of each said transmitter system is the same as each said n×1 combiner of each said receiver system.

18. The plurality of coherent optically controlled phased array antenna sub-systems of claim 11 wherein each said transmission fiber provided with optical amplification means is the same in both said transmitter and receiver systems.

19. The plurality of coherent optically controlled phased array antenna sub-systems of claim 18 wherein said optical amplification means comprises a fiber optical amplifier.

20. The plurality of coherent optically controlled phased array antenna sub-systems of claim 18 wherein said optical amplification means comprises a semiconductor optical amplifier.

* * * * *